United States Patent [19]

Stout et al.

[11] Patent Number: 5,059,114

[45] Date of Patent: Oct. 22, 1991

[54] HEATING APPARATUS AND METHOD

[75] Inventors: Chester H. Stout, Stow; John Van Domelen, Gates Mills, both of Ohio

[73] Assignee: Automated Packaging Systems, Inc., Twinsburg, Ohio

[21] Appl. No.: 508,501

[22] Filed: Apr. 9, 1990

Related U.S. Application Data

[63] Continuation of Ser. No. 283,262, Dec. 9, 1988, abandoned.

[51] Int. Cl.[5] ..... F23N 5/24

[52] U.S. Cl. ..... 431/3; 431/22; 431/29; 431/89; 239/113

[58] Field of Search ..... 431/3, 12, 19, 22, 29, 431/16, 121, 89, 346, 6; 239/112, 113, 75; 137/187, 606

[56] References Cited

U.S. PATENT DOCUMENTS

| | | | |
|---|---|---|---|
| 1,320,696 | 11/1919 | Knight | 431/22 X |
| 2,013,302 | 9/1935 | Ferguson | 239/113 |
| 2,067,622 | 1/1937 | Smith | 431/22 |
| 2,157,732 | 5/1939 | Piazze . | |
| 2,459,234 | 1/1949 | McDowall . | |
| 2,591,626 | 4/1952 | Sloan | 431/29 |
| 2,660,219 | 11/1953 | Haas et al. . | |
| 2,676,642 | 4/1954 | Bergstein et al. . | |
| 2,678,679 | 5/1954 | Bergstein . | |
| 2,818,110 | 12/1957 | Rulseh | 431/29 X |
| 2,938,577 | 5/1960 | Hughey | 431/29 X |
| 3,066,064 | 11/1962 | Pommer . | |
| 3,145,242 | 8/1964 | Bryan . | |
| 3,684,560 | 8/1972 | Brichard et al. | 239/79 |
| 3,850,716 | 11/1974 | Podvin . | |
| 4,243,449 | 1/1981 | Swartz . | |
| 4,308,087 | 12/1981 | Johnson . | |
| 4,339,324 | 7/1982 | Haas . | |
| 4,424,105 | 1/1984 | Hanson . | |
| 4,425,215 | 1/1984 | Henes . | |
| 4,678,120 | 7/1987 | Matsuo | 431/346 X |

*Primary Examiner*—Carl D. Price

*Attorney, Agent, or Firm*—Watts, Hoffmann, Fisher & Heinke

[57] ABSTRACT

A purging system for a heating apparatus according to the present invention includes a pair of three-way valves interposed serially between a burner head and a supply of combustible fluid. Each valve is connected to a switch for switching between two modes of conduction. One of the valves is controlled by a remote switch so that the burner may be flushed manually by an operator. The other switch senses whether the heating apparatus is operating and flushes the burner automatically when the apparatus is inoperative.

20 Claims, 1 Drawing Sheet

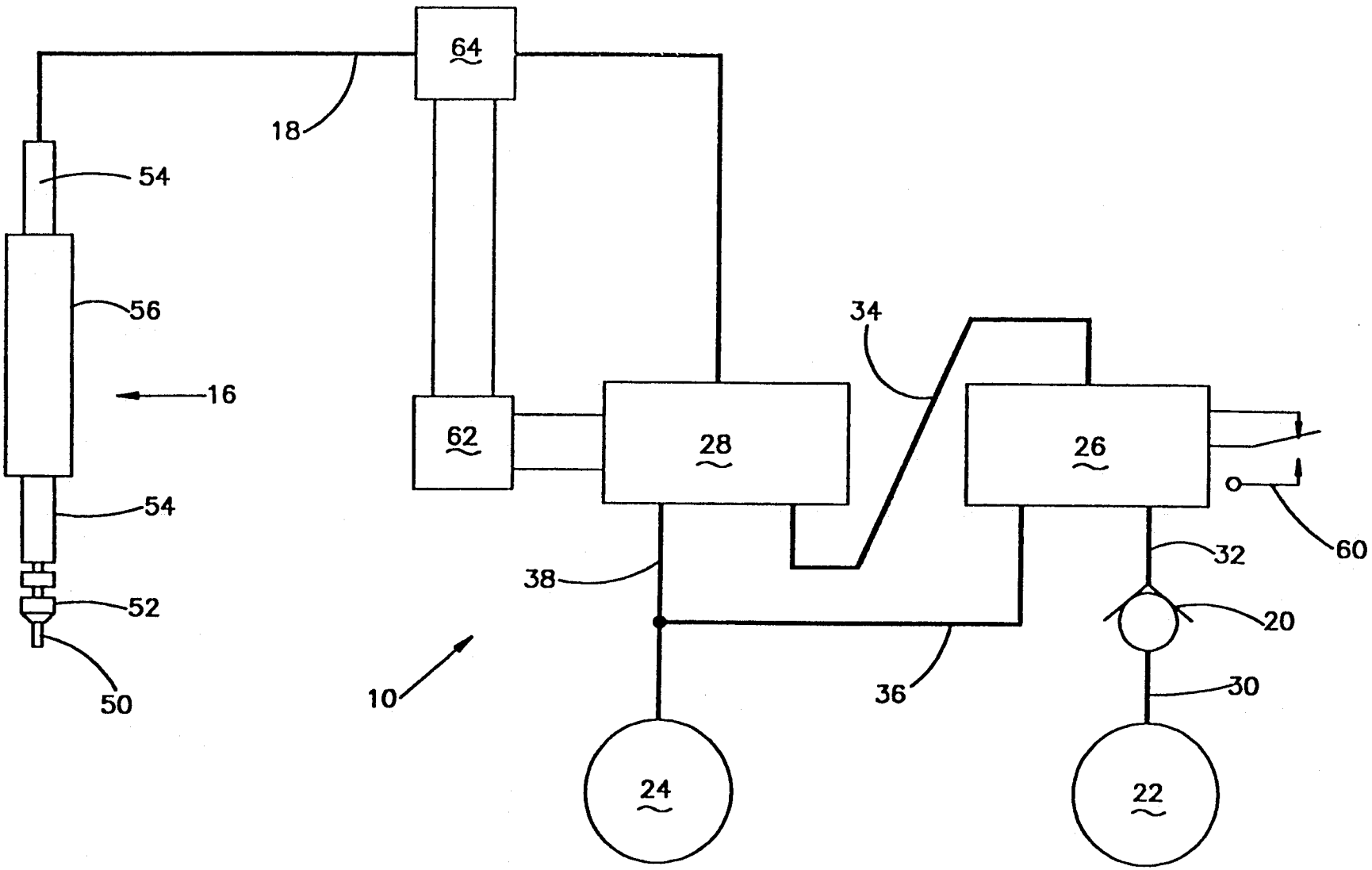
60
20
32
30
22
26
36
34
28
24
38
64
62
10
18
16
54
56
54
52
50

HEATING APPARATUS AND METHOD

This is a continuation of application Ser. No. 07/283,262 filed on Dec. 9, 1990, now abandoned.

TECHNICAL FIELD

The present invention relates generally to burners and in particular burners with devices for quick extinction of the burner flame.

BACKGROUND ART

Perhaps the simplest and most ancient of heating techniques is to expose the workpiece directly to a flame. Of the many techniques used by industry for generating a flame, one of the most common is a gas burner in which a jet of combustible gases exiting a burner head is ignited. The heat generated by the burner is controlled to some degree by controlling the flow rate of the gases, and the position and shape of the flame, by adjusting the configuration of the burner head.

It is sometimes necessary to quickly extinguish the flame generated by a gas burner to avoid setting the workpiece aflame or to allow workmen access to the burner head or workpiece to correct a malfunction.

Furthermore, gas burners sometimes "flashback," or propagate the flame backwards along the gas flow path into the burner apparatus itself, perhaps damaging the apparatus or causing an explosion capable of injuring workers nereby.

More specifically, fluids are driven to flow by fluid pressure. For example, the fuel in a burner is driven toward the burner head at a flow rate dependent in part on the pressure exerted by the fuel supply. Once past the burner head, the fuel is ignited and burns. If the amoutn of fuel reaching a flame position in a given time balances the amount of fuel consumed in that time, the flame remains stationary.

A drop in pressure slows down the fuel. Thus, if the flame is stationary before a pressure drop, the rate of combustion may exceed the flow rate after the pressure drop. The flame could then move upstream, "looking" for more fuel. Unless stopped or extinguished, this "flashbakc" will enter the burner and move upstream into the heating apparatus.

The danger of flashback is especially acute where the gas being supplied to the burner is a mixture of a combustible gas and oxygen. For example, if the gas being supplied is a stoichiometric mixture of hydrogen and oxygen from a gas generator which dissociates water into its component elements, the rate of combustion is high. As a result, a smaller drop in pressure will result in a more pronounced flashback.

One technique for preventing flashback is to use a one-way check valve, which permits the flow of gas only toward the burner head so as (theoretically) not to permit a combustion reaction to flow back into the apparatus. Unfortunately, a check valve may conduct enough heat into the apparatus, to allow the gas behind the valve the ignite. Even were the check valve to prevent flashback in all conceivable cases, it is a passive device which cannot extinguish the flame downstream of its position to allow access to the burner head or workpiece.

DISCLOSURE OF THE INVENTION

These drawbacks of the prior art are overcome in a heating device featuring a burner which includes a novel purging system made in accordance with the present invention.

In one embodiment, the burner includes a burner head, a conduit supplying combustible fluid to the burner head, a combustible fluid supply and a flame retardant fluid supply.

A valve interposed between the burner head and the combustible fluid supply has first and second modes of conduction, i.e. will open one conduction path in one mode and another conduction path in another. In the first mode, the valve conducts combustible fluid to the burner head. In the second mode, the valve flushes the burner head with flame-retardant fluid. A switch is provided for switching the valve between the first and second modes of conduction.

The combustible fluid is preferably either hydrogen, with an independent oxygen supply to the burner head, or a mixture of hydrogen with oxygen. The most economical choice for a flame-retardant fluid is air.

The valve is preferably a three-way solenoid valve, i.e. a solenoid valve capable of two modes of conduction.

In another embodiment of the invention, a second valve is interposed betwen the combustible fluid supply and the burner head. The second valve is also capable of two modes of conduction. A second switch is provided for switching the second valve between the two modes. The pair of valves acts as a logical "NOR" gate, conducting combustible fluid to the burner head only when both are switched to one of their respective modes of conduction and flushing the burner head whenever one is switched to the other mode.

The second valve is preferably also a solenoid valve.

One of the switches preferably includes a pressure sensor interposed between the second valve and the burner head. When the pressure sensor indicates that pressure int he conduit supplying the burner head has fallen below a threshold value, a control in the switch switches the corresponding valve to flush the system. As an alternative, one of the switches is interconnected with an apparatus control switch for flushing the conduit and burner head whenever the apparatus is not operating or whenever an operator determines, for whatever reason, the flame should be extinguished.

More specifically, the apparatus includes a burner, the burner, in turn, having a burner head, a gas generator for generating and supplying a mixture of hydrogen and oxygen, a conduit for conducting the mixture to the burner head and a pressurized air supply.

A first three-way solenoid valve is interposed between the gas generator and the burner head so that, in one mode of conduction, the solenoid conducts the mixture of hydrogen and oxygen to the burner head for combustion. In the other mode of conduction, the first solenoid conducts air from the pressurized air supply so as to flush out the burner head.

A second three-way solenoid valve is interposed between the valve and the burner head so that, in one of its modes of conduction, the second solenoid conducts whichever fluid is conducted by the first solenoid. In the other mode of conduction, the second solenoid conducts air from the pressurized air supply so as to flush out the burner head.

Ideally, the mixture of hydrogen and oxygen is substantially in the ratio of eight parts hydrogen to one part oxygen, an ideal ratio for combustion which may be obtained from the decomposition of water. Furthermore, each of the valves is controlled by a corresponding switch, one of which is a remote switch allowing the operator to manually flush the system and the other of which senses when the apparatus is in an operating mode so as to flush the burner when the apparatus is inoperative.

One of the outstanding features of the invention is that a purging system is provided for flushing out the burner. Provision is made for activating the valve either manually or automatically when a pressure drop indicates that a flashback is likely. This allows the operator to flush out the burner quickly by a remote switch if he observes a flashback or needs quick access to the burner head or workpiece. On the other hand, the system is capable of automatically flushing the system where conditions are favorable for flashback. This feature decreases the amount of operator attention required to run the apparatus, thereby reducing labor cost.

If, alternatively, one of the valves is interconnected with the apparatus control switch, the apparatus is flushed automatically during shut-down. This reduces the number of steps required to shut down the machine, reducing the chance for injury or damage due to human error.

Accordingly the object of this invention is to provide a novel and improved heating system including structure to purge the system and a method of providing a safe flame heater.

Additional features and advantages of the invention will become apparent and a fuller understanding obtained by reading the following detailed description in connection with the accompanying drawings.

BRIEF DESCRIPTION OF THE DRAWINGS

The Figure is a schematic diagram of a heating apparatus featuring a purging system according to the present invention.

BEST MODE FOR CARRYING OUT THE INVENTION

Referring now to the Figure, a heating apparatus according to the present invention is shown generally at 10. The heating apparatus, particularly suited for fusing parts of workpieces, includes a burner having a burner head 16 which positions and shapes the flame during operation.

A fuel supply conduit 18 is connected to the burner head 16. The conduit 18 receives fuel from a three-way solenoid valve 28. The solenoid 28, in turn, is coupled through conduit 38 to a pressurized air supply 24 and through an output conduit 34 to the output of three-way solenoid valve 26. Solenoid valve 26 is coupled through conduit 36 to pressurized air supply 24 and through conduits 32 and 30 to a gas generator 22. A flashback arrestor 20 is interposed between the gas generator 22 and the valve 26 along the conduits 30 and 32.

In the preferred embodiment of the invention, the burner head 16 comprises a flame torch which conducts the hydrogen/oxygen mixture from the conduit 18 to a tip 50. The tip 50 positions the flame near or onto the workpiece. Leading to the tip is a nozzle 52 which may be adjusted to control somewhat the size and shape of the flame. Above the nozzle 52 is an hollow tube 54 which is supported by a collar 56. Hydrogen/oxygen mixture is received from the conduit 18 by the tube 54 through a connection at the top of the tube 54. The position of the burner head 16 is controlled through an adjustable support (not shown) which engages the collar 56.

The conduit 18 is preferably composed of flexible tubing. The tubing may be connected with the tube 54 and the solenoid valve 28 by stretching the tubing over the end of the tube 54 or a nipple (not shown) on the outlet of the solenoid valve 28. The joint may then be sealed by clamping or tying the wall of the tubing against the tube end or nipple.

The flashback arrestor 20 may be in the form of a one-way check valve or other device to prevent burning gases from passing back into the gas generator 22 during flashback.

The gas generator 22 provides a stoichiometric mixture of hydrogen and oxygen, i.e. a mixture of approximately eight parts oxygen to one part hydrogen by mass, which is highly efficient for combustion. An example of a device which generates a stoichiometric mixture by electrolyzing water is disclosed in U.S. Pat. No. 4,425,215 to Henes; U.S. Pat. No. 4,424,105 to Hanson and U.S. Pat. No. 4,339,324 to Haas.

The pressurized air supply 24 may be, for example, a compressor or a pressurized tank capable of generating sufficient pressure to force the combustion gases out of the system quickly. Though air appears to be the cheapest, other flame-retardant or inert gases, such as helium, may be used for flushing the burner.

Two solenoid valves, 26, 28, are interposed between the burner head 16 and the generator 22. Each of the solenoid valves 26, 28 is a three-way solenoid of familiar construction. In one such device, a spool composed of a ferromagnetic material is placed in a reversible magnetic field so that movement in either direction blocks one intake port and opens the other to communication with an output port. The sense of the magnetic field may be controlled by an external switch, such as those marked 60 and 62.

The first of the solenoids, 26, is electrically connected to a remote push button switch 60. Under ordinary circumstances, the valve 26 is in a mode of conduction which allows hydrogen/oxygen mixture entering from the conduit 32 to flow through to the output conduit 34. By pressing the remote switch 60, however, an operator can switch the valve 26 into a mode of conduction where pressurized air from the supply 24 communicates with the output conduit 34.

If the generator 22 includes a pressure sensor for de-activating the generator when the gas pressure falls below a threshold value, a separate pressure transducer, as indicated at 64, may be omitted. One skilled in the art will still recognize, however, that the provision of an extra pressure sensor 64 in combination with the valve 28 will provide an extra margin of safety against flashback entering the system.

The second of the solenoids, 28, is electrically connected to a switch control 62. The switch control 62, in turn, is electrically connected to a pressure transducer. Ordinarily, the valve 28 is in a mode of conduction which allows the output from the valve 26 to communicate with the fuel supply conduit 18. When the transducer 64 senses a fall in pressure sufficient to create a significant risk of flashback, however, the transducer signals the switch control 62. The switch control 62 then switches the valve 28 into a mode of conduction which allows pressurized air to reach the conduit 18.

In the preferred embodiment, the hydrogen/oxygen mixture is fed to the burner head at a pressure of approximately 5–6 psi. The pressurized air, on the other hand, is maintained at a pressure of 20 lbs. The pressure transducer must be capable of accurately measuring pressures in the range of 5–10 psi while withstanding pressures in the range of 20 psi. A number of such devices are commercially available.

Alternatively, the switch 62 could be connected to an apparatus control switch in parallel with the control system of the apparatus so that the valve 28 admits air to the conduit 18 and burner head 16 whenever the system is not operating.

In practice, the two valves 26, 28 act as a logical "NOR" gate, conducting hydrogen/oxygen mixture to the conduit 18 and burner 16 only when neither of the switches 60 and 62 are activated. When switch 62 receives a signal indicating that the heating apparatus is inoperative, air flows through the valve 28 to the conduit 18, flushing the system. Alternatively, if an operator presses the remote switch 60 while the apparatus is operative, air flows through the solenoid 26. The solenoid 28 receives the air through output conduit 34 and conducts it to the fuel supply conduit 18. This allows the operator to flush the system manually during operation while relieving the operator of the need to flush out the system manually during shut-down.

While preferred embodiments of this invention have been described in detail, it will be apparent that certain modifications or alterations can be made therein without departing from the spirit or scope of the invention as set forth in the appended claims.

We claim:

1. A heating apparatus having a burner for burning a combustible fluid, said burner comprising:

a) a burner head;

b) a conduit for conducting combustible fluid to the burner head;

c) a combustible fluid supply for supplying combustible fluid to the conduit;

d) valve means interposed between the burner head and the combustible fluid supply and having first and second modes of conduction, said valve means being adapted to conduct combustible fluid from said combustible fluid supply when in the first mode of conduction;

e) a flame-retardant fluid supply for supplying a flame-retardant fluid to the valve means, said valve means being adapted to conduct the flame-retardant fluid from said flame-retardant fluid supply when in the second mode of conduction;

f) first and second valve actuators connected to said valve means such that said valve means conducts said combustible fluid when both said first and second valve actuators are inoperative and conducts said flame-retardant fluid when at least one of said first and second valve actuators is operated.

2. An apparatus according to claim 1 wherein said valve means comprises first and second solenoid valves;

said first solenoid valve interposed between the burner head and the combustible fluid supply and connected to said first valve actuator for conducting one of said combustible and flame-retardant fluids, said first valve being adapted to conduct combustible fluid from said combustible fluid supply when said first valve is inoperative and to conduct frame-retardant fluid from said flame retardant fluid source when said first valve actuator is operated;

a second valve interposed between the burner head and the first valve and connected to the second valve actuator, said second valve being adapted to conduct said one of said combustible and flame-retardant fluids conducted by said first valve when the second valve is inoperative and to conduct flame-retardant fluid from said flame-retardant fluid supply when the second valve actuator is operated.

3. An apparatus according to claim 1 wherein the flame-retardant fluid supply supplies air.

4. An apparatus according to claim 1 including an apparatus control switch for switching the apparatus between operative and inoperative modes and wherein one of said first and second valve actuators in interconnected with the apparatus control switch for actuating the valve means into the second mode of conduction when the apparatus is in an inoperative mode, thereby causing flame-retardant fluid to be conducted toward the burner head.

5. An apparatus according to claim 1 including a detecting means for detecting a flashback condition in the apparatus, one of said first and second valve actuators being responsive to said detecting means for actuating the valve means into the second mode of conduction when the detecting means detects a flashback condition, thereby causing flame-retardant fluid to be conducted toward the burner head.

6. An apparatus according to claim 1 wherein the combustible fluid supply supplies a stoichiometric mixture of hydrogen and oxygen.

7. A heating apparatus having a burner for burning a combustible fluid comprising:

a) a burner head;

b) a conduit for conducting combustible fluid to the burner head;

c) a combustible fluid supply for supplying combustible fluid to the conduit;

d) a first valve interposed between the burner head and the combustible fluid supply and having a first and a second mode of conduction, said first valve being adapted to conduct combustible fluid from said combustible fluid supply when in the first mode of conduction;

e) a flame-retardant fluid supply for supplying a flame-retardant fluid to the first valve, said first valve being adapted to conduct flame-retardant fluid from said flame-retardant fluid supply when in the second mode of conduction;

f) a first switch for switching the first valve between the first and second modes of conduction;

g) a second valve interposed between the burner head and the first valve and having a third and a fourth mode of conduction.

i) said second valve being adapted to conduct combustible fluid from said combustible fluid supply when the first valve is in the first mode of conduction and the second valve is in the third mode of conduction, ii) said second valve being adapted to conduct flame-retardant fluid from said flame-retardant fluid supply when the first valve is in the second mode of conduction and the second valve is in the third mode of conduction, and iii) said second valve being adapted to conduct flame-retardant fluid from said flame-retardant fluid supply when the second valve is in the fourth mode of conduction, and h) a second switch for switching the second valve between the third and fourth modes of conduction.

8. An apparatus according to claim 7 wherein one of said first and second valves is a solenoid valve.

9. An apparatus according to claim 7 wherein the combustible fluid supply supplies hydrogen gas.

10. An apparatus according to claim 7 wherein the flame-retardant fluid supply supplies air.

11. An apparatus according to claim 7 wherein one of said first and second switches includes i) a sensor for sensing the pressure in the conduit and ii) a control for switching one of said first and second valves to one of said second or fourth modes of conduction when he sensor senses that the pressure in the conduit has fallen below a threshold level.

12. A heating apparatus for heating a workpiece having a burner, said burner comprising:

a) a burner head;

b) a conduit for conducting a mixture of hydrogen and oxygen tot he burner head;

c) a combustible fluid supply for supplying a mixture of hydrogen and oxygen to the conduit;

d) a pressurized air supply for supplying pressurized air to the conduit;

e) a first solenoid valve interposed between the burner head and the combustible fluid supply and having first and second modes of conduction, said first valve being adapted to conduct the mixture of hydrogen and oxygen from the combustible fuel supply when in the first mode of conduction and air from the pressurized air supply when in the second mode of conduction;

f) a second solenoid valve interposed between the burner head and the first valve and having third and fourth modes of conduction, i) said second valve being adapted to conduct the mixture of hydrogen and oxygen from the combustible fuel supply when the first valve is in the first mode of conduction and the second valve is in the third mode of combustion, ii) said second valve being adapted to conduct air from the pressurized air supply when the first valve is int he second mode of conduction and the second valve is in the third mode of conduction, and iii) said second valve being adapted to conduct air from the pressurized air supply when the second valve is in the fourth mode of conduction;

g) a first switch for switching the first valve between the first and second modes of conduction; and h) a second switch for switching the second valve between the third and fourth modes of conduction.

13. An apparatus according to claim 12 wherein the mixture of hydrogen and oxygen comprises approximately eight parts oxygen to one part hydrogen by mass.

14. An apparatus according to claim 12 wherein the oxygen/hydrogen supply includes a generator for generating the mixture of hydrogen and oxygen.

15. An apparatus according to claim 12 wherein one of said first and second switches includes i) a sensor for sensing the pressure in the conduit and ii) a control for switching one of said first and second valves to one of said second or fourth modes of conduction when the sensor senses that the pressure in the conduit has fallen below a threshold level.

16. An apparatus according to claim 12 including an apparatus control switch for switching the apparatus between operative and inoperative modes and wherein one of said first and second switches is interconnected with the apparatus control switch for switching one of said first and second valves to one of said second or fourth modes of conduction when the apparatus is in an inoperative mode.

17. A process of performing a work operation with a torch comprising:

a) delivering a supply of a combustible gas to a torch;

b) igniting the gas to provide a work performing flame jet;

c) monitoring the torch for flashback conditions;

d) upon detection of a flashback condition, signaling a first three-way valve to terminate the delivery of the combustible gas and purge combustible gas from at least a portion of the conduit and the torch;

e) upon shut-down of the torch, signaling a second three-way valve to terminate the delivery of the combustible gas and purge combustible gas from at least a portion of the conduit and the torch.

18. The process of claim 17 wherein the combustible gas is hydrogen.

19. The process of claim 17 wherein the delivery step comprises delivering a combustible gas comprising a stoichiometric mixture of hydrogen and oxygen and the monitoring step comprises monitoring a flow parameter in the combustible gas for flashback conditions.

20. The process of claim 17 wherein he step of monitoring the torch for flashback conditions includes monitoring the pressure of gas supplied to the torch.

* * * * *